US005154386A

United States Patent [19]

Heck

[11] Patent Number: 5,154,386

[45] Date of Patent: Oct. 13, 1992

[54] PIVOTAL MOUNT FOR A RADOME

[76] Inventor: Gordon Heck, 2255 Unit L, Pleasant Valley Rd., Camarillo, Calif. 90310

[21] Appl. No.: 760,561

[22] Filed: Sep. 16, 1991

[51] Int. Cl.[5] ..... A47B 96/06

[52] U.S. Cl. ..... 248/230; 248/218.4

[58] Field of Search ..... 248/291, 230, 311.2, 248/218.4, 219.4, 231.6

[56] References Cited

U.S. PATENT DOCUMENTS 2,912,205 11/1959 Toune ..... 248/311.2 X
4,860,909 8/1989 Leumi ..... 248/291 X
4,878,642 11/1989 Kirby, Jr. ..... 248/311.2

*Primary Examiner*—Blair M. Johnson
*Attorney, Agent, or Firm*—Roger A. Marrs

[57] ABSTRACT

A pivotal mount for an electronic beam generating apparatus, such as radar, loran or the like, is disclosed herein having a fixed member and a rotating member carried on the fixed member. The fixed member includes a clamp for securement onto a vessel's mast and a pair of bearings defining aligned bores. The rotating member includes an L-shaped platform with an outwardly projecting shaft insertably receivable within the bearing bores and further having spaced-apart mounting elements for supporting and securing the electronic beam generating apparatus.

1 Claim, 1 Drawing Sheet

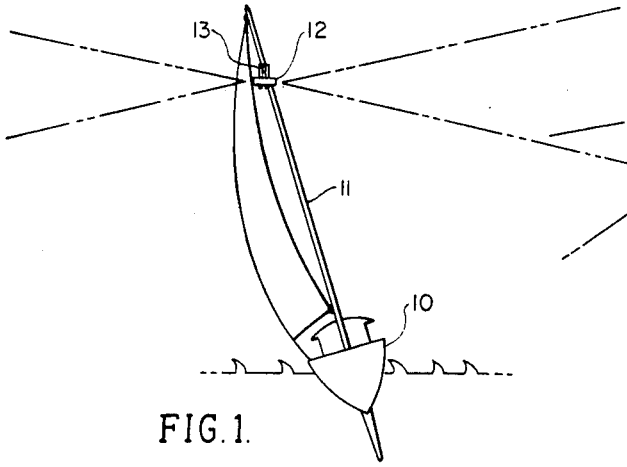
FIG. 1.
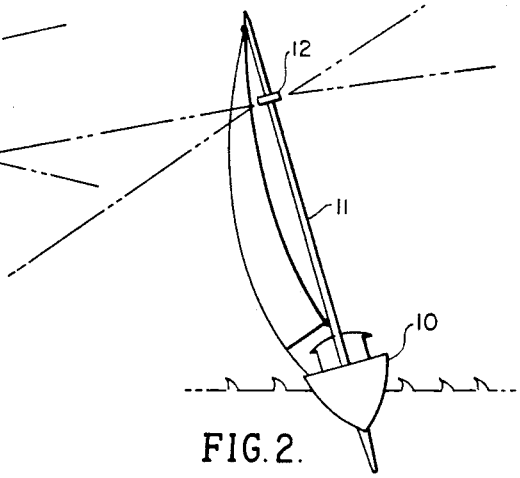
FIG. 2.
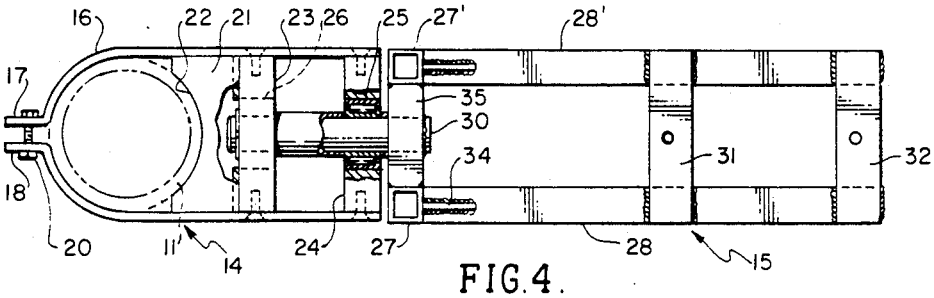
FIG. 4.
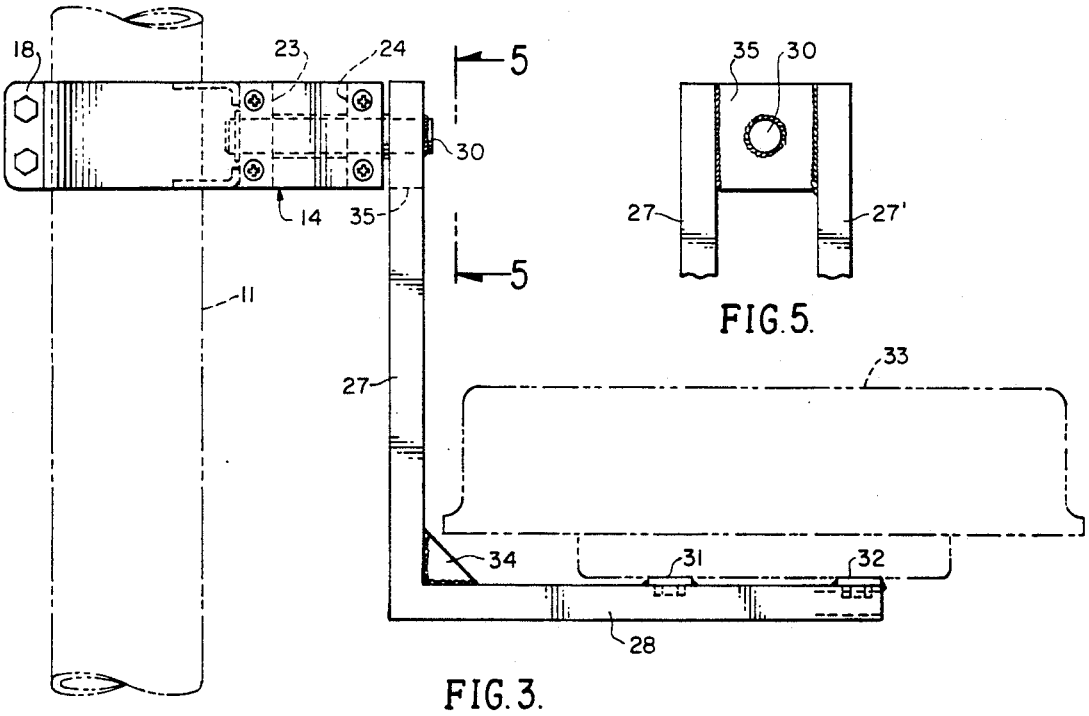
FIG. 3.
FIG. 5.

PIVOTAL MOUNT FOR A RADOME

BACKGROUND OF THE INVENTION

1. Field of the Invention

The present invention relates to the field of mounting devices for electronic equipment, and more particularly to a novel pivoting platform adapted to be fixed to the mast of a sailing or motor vessel, and which includes a support for electronic beam generating apparatus whereby the transmitted beam is stabilized in a selected direction regardless of vessel roll due to wave condition.

2. Brief Description of the Prior Art

In the past, it has been the conventional practice to mount electronic beam generating equipment, such as radar, loran or the like onto a fixed mast upwardly projecting from the deck of a sailboat or the like. As the vessel travels, it is subjected to a variety of ocean wave conditions that cause the vessel to rock, pitch and yaw. These motions adversely affect the transmission of electronic beams generated from the equipment so that the equipment is only operative over a small angular area. For example, large waves will cause the vessel to rock so that the transmitted beam may be directed into the sky rather than along the surface of the water towards the horizon. In such an event, the display for the electronic equipment would not show the presence of objects on the surface of the sea. However, the next time the wave subsides and the vessel is in a trough, the angle may be such that the emitted or transmitted beam is directly into the surrounding water. Again, no display will be given on the equipment. Therefore, it can be seen that fixed mounting of such electronic beam transmitting or generating devices will be relatively inefficient due to the rocking of the vessel as it travels through a water medium.

Therefore, a long-standing need has existed to provide a means whereby electronic beam emitting or transmitting apparatus can be mounted on a pivoting platform so that the effects of roll will not be reflected in the direction of electronic beam transmission. Thus, a stabilizing means for pivotally mounting such equipment is needed, which will be readily convenient to install, maintain and used by relatively unskilled and non-technical personnel.

SUMMARY OF THE INVENTION

Accordingly, the above problems and difficulties are obviated by the present invention which includes a novel mounting means for conventional electronic beam transmitting or emitting apparatus, which includes a fixed member attached to the mast of the vessel and a pivotal platform that is rotatably mounted on the fixed portion, and which further includes means for securing the conventional electronic apparatus to the pivoting platform. In one form of the invention, a fixture is provided with a clamping arrangement so that the fixture may be readily secured along the length of the mast at a selected location and which also includes bearing means defining a bore into which a shaft is insertably received from the pivotal platform. The platform may take the configuration of an L-shaped platform having the shaft carried on the upper end of the L, while the lower or horizontal portion of the L includes a pair of spaced-apart mounting brackets to which the electronic equipment can be secured. Thus, the electronic equipment will be maintained relatively stabilized because of gravitational forces as the mast is tilted or angled in response to vessel movement induced by wave action.

Therefore, it is among the primary objects of the present invention to provide a novel means by which conventional electronic beam generating and transmitting apparatus can be movably mounted on a mast of a vessel so that the equipment is stabilized with respect to constant beam generation in a given direction.

Another object of the present invention is to provide a novel movable mounting platform for conventional electronic equipment that will rotate in response to rolling movement of a vessel so that transmitted beams and echo reception are maintained in a given direction.

Another object of the present invention is to provide a novel movable mounting means for electronic beam generating and echo reception which is easy to install by non-technical persons.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a diagrammatic view of a sailboat having the movable mounting platform carried on the mast thereof so as to stabilize the transmitted and echo reception of the electronic beam;

FIG. 2 is a view similar to the view of FIG. 1 illustrating the fixed mounting arrangement conventionally used for mounting such electronic equipment on a vessel;

FIG. 3 is an enlarged side-elevational view of the inventive pivotal mount used in the version shown in FIG. 1;

FIG. 4 is a top plan view of the inventive pivotal mount shown in FIG. 3; and FIG. 5 is a fragmentary front elevational view of the pivot shown in FIG. 3 as taken in the direction of arrows 5—5 thereof.

DESCRIPTION OF THE PREFERRED EMBODIMENT

Referring to FIG. 1, a sailing vessel is indicated by numeral 10 which includes an elongated mast 11 that mounts a conventional electronic beam generating and echo receiving equipment, such as a radome, identified by numeral 12. The radome is mounted on the pivoting platform incorporating the inventive concept and is indicated in general by the numeral 13. When the pivotal mount of the present invention is employed, the radome 12 will be stabilized and will remain substantially in its upright or level position so that the radar transmitted beam and the echo response will be within the angle of the broken line designations. The direction and angle is maintained constant and stabilized regardless of the roll attitude of the vessel 10. Large or small waves will cause the vessel to tilt or tip, such as shown in FIG. 1; however, the radome 12 will be stabilized in a level position regardless of the rolling condition of the vessel.

Referring to FIG. 2, the vessel 10 is still in a rolling condition due to the wave action; however, the radome 12 is mounted on a conventional non-movable and non-pivoting mount carried on the mast 11 so that the angle and direction of the emitted or transmitted radar beam will be into the sky on one side of the boat or vessel and will be directed into the water at the other side of the vessel. Therefore, as long as the sailboat maintains this "heel", the display of the radar set within the cabin of the vessel will not properly register any objects which interfere with the radar beam. Therefore, a dangerous object could be relatively close to the vessel 10 and would not be picked up and displayed by the radome 12. However, the same dangerous object would be picked up by the radome 12 when used on the pivotal mount 13.

Referring to FIGS. 4–5 inclusive, it can be seen that the pivotal mount of the present invention includes a fixed member 14 and a movable portion 15. The fixed portion includes a clamp construction 16 that terminates at one end in flanges 17 and 18 that may readily be joined by a fastener 20 so as to clamp about the exterior surface of mast 11. The midsection of the fixed member 14 includes a mounting bracket 21 having a semicircular cutout 22 adapted to bear against the opposite side of the mast 11 from the side secured by flanges 17 and 18 and fastener 20. The backside of the flange 21 is coupled to one side of a bearing retainer 23 which is in spaced relationship with respect to a second bearing retainer 24. The bearing retainers 23 and 24 are on the opposite end of the fixed member from the end carrying the flanges 17 and 18. The bearing retainers 23 and 24 retain bearings 25 and 26 in alignment so that the respective bores of the bearing lie along the same turning axis.

The movable or pivotal platform 15 is of L-shaped configuration in side elevation and, as illustrated in FIG. 3, includes a vertical portion 27 and a horizontal portion 28. The top of the vertical portion 27 includes a fixed shaft 30 which projects outwardly from the vertical portion 27 into insertable relationship with the bores of the bearings 25 and 26. Therefore, the shaft 30 revolves within the bores about the fixed member 14 so that the pivotal platform pivots about the turning axis so as to be stabilized in a substantially horizontal position by gravitational forces. Therefore, as the vessel 10 rocks, the platform 15 will remain relatively horizontal.

The horizontal portion 28 of the pivoting platform includes spaed-apart mounting bars 31 and 32 which are carried in fixed spaced-apart relationship with respect to each other on the end of the horizontal section or portion 28. The radome is indicated in broken lines and by numeral 33 which may be of any standard or conventional electronic beam emitting and echo receiving apparatus. Although the apparatus is not illustrated, it is considered to be within the housing of the radome 33, and since it is of conventional design and construction, does not form a part of the present invention. The vertical and horizontal portions 27 and 28 are reinforced by gussets, such as gusset 34, welded at the intersection of the vertical and horizontal portions. The vertical and horizontal portions further comprise parallel sections which are spaced apart at the top of the vertical portion 7 by a square piece 35 and separated at the outward end of the horizontal portion 28 by the bars 31 and 32. The pair of segments associated with the portions 27 and 28 are further illustrated by the numerals 27' and 28'.

Such segments are further illustrated more clearly in FIGS. 4 and 5 and these FIGURES further illustrate the rotatable mounting of the shaft 30 in the roller bearings 25 and 26 carried on the bearing retainers 23 and 24.

In view of the foregoing, it can be seen that the inventive rotary platform of the present invention compensates for the non-parallel relationship of the transmitted radar beam with the deck of the vessel 10. At the dock, the radome 33 is mounted parallel to the deck of the vessel; however, when the vessel is at sea, the sailboat will heel so that the greater the degree of heel, the greater the distance of the radar signal to the water so as to create a blind spot that increases in proportion to the heel angle of the vessel. This normally would create a dangerous situation, as shown in FIG. 2. With the inventive pivotal platform, the radome would always be parallel to the water regardless of the angle of the boat 10. The weight of the radome and the ease of movement with the needle bearings achieve stabilization of the movable or pivotal platform 15 with respect to the fixed member 14. If free swinging or extreme wind conditions create a problem, the movable portion 28 may be hydraulically dampened by adding a cylinder filled with fluid and attaching it to the pivot arm so as to yieldably restrict the movement of the platform. A recirculating ducting system can be provided so that the fluid will not completely stop pivotal rotation but merely dampen the rotational effect.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a movable mount for maintaining beam radiating electronic equipment in a stabilized, level position comprising the combination of:

a sailboat having an upright mast normal to the deck of said sailboat;

a fixed member movably secured on a selection location of said mast;

a movable member pivotally carried on said fixed member;

clamping means integrally provided on said fixed member for releasably securing said fixed member to said mast;

mounting means on said movable member for supporting the electronic equipment;

said movable member is of L-shaped configuration in side elevation having a horizontal portion and a vertical portion;

a pivot shaft outwardly projecting from said vertical portion;

said clamping means includes bearing means rotatably supporting said shaft;

said movable member vertical and horizontal portions include parallel segments in spaced-apart relationship;

said mounting means includes a pair of cross bars in parallel spaced relationship separating said segments of said horizontal portion;

said vertical portion includes a plate on which said shaft is secured; and said plate secured between said segments of said vertical portion.

* * * * *